US005937519A

United States Patent [19]

Strand

[11] Patent Number: 5,937,519

[45] Date of Patent: Aug. 17, 1999

[54] METHOD AND ASSEMBLY FOR MANUFACTURING A CONVOLUTED HEAT EXCHANGER CORE

[75] Inventor: Joel J. Strand, Buffalo, Minn.

[73] Assignee: Zero Corporation, Los Angeles, Calif.

[21] Appl. No.: 09/053,382

[22] Filed: Mar. 31, 1998

[51] Int. Cl.[6] ..... B21D 13/02

[52] U.S. Cl. ..... 29/890.03; 72/385

[58] Field of Search ..... 29/726, 727, 33 G, 29/890.03; 72/184, 187, 379.6, 385, 403

[56] References Cited

U.S. PATENT DOCUMENTS

| | | | |
|---|---|---|---|
| 1,849,944 | 3/1932 | Medville . | |
| 2,252,209 | 8/1941 | Schank et al. . | |
| 2,677,993 | 5/1954 | Ens . | |
| 3,318,128 | 5/1967 | Rhodes . | |
| 3,667,268 | 6/1972 | Rech . | |
| 3,760,624 | 9/1973 | Robinson . | |
| 3,838,590 | 10/1974 | Van Dijk . | |
| 3,850,018 | 11/1974 | Drosnin . | |
| 3,988,917 | 11/1976 | Mykolenko . | |
| 4,201,119 | 5/1980 | Wolf . | |
| 4,275,581 | 6/1981 | Miller . | |
| 4,384,611 | 5/1983 | Fung . | |
| 4,507,948 | 4/1985 | Wallis . | |
| 4,650,102 | 3/1987 | Arbetter . | |
| 4,838,065 | 6/1989 | Wallis . | |
| 4,888,972 | 12/1989 | Rouse . | |
| 5,628,221 | 5/1997 | Pardi et al. . | |
| 5,694,803 | 12/1997 | Ervin et al. | 72/385 |
| 5,709,771 | 1/1998 | Fritzman . | |
| 5,722,145 | 3/1998 | Haushalter et al. . | |
| 5,794,483 | 8/1998 | Haushalter et al. | 72/379.6 |
| 5,823,253 | 10/1998 | Kontu | 72/385 |

FOREIGN PATENT DOCUMENTS

| | | |
|---|---|---|
| 0143136 | 9/1983 | European Pat. Off. . |
| 2156108 | 3/1985 | United Kingdom . |

OTHER PUBLICATIONS

Geyer's Manufacturing & Design, Inc., Pusher Bar Pleater Instruction Manual, May 1996.

Emerson & Renwick, Heat Exchanger Equipment, 1987.

Robinson Fin Machines, Inc. "Quality Fin Products for Industry" pp. 12843–12846 Published Prior to Filing Date.

Kintex Fin Stock Brochure No. 060782–1 Published Prior to Filing Date.

*Primary Examiner*—Irene Cuda
*Attorney, Agent, or Firm*—Quarles & Brady LLP

[57] ABSTRACT

A method of manufacturing a convoluted heat exchanger core from a continuous sheet of thermally conductive metallic material includes providing a pusher bar assembly having a table, a pusher bar plate mounted transversely across the table and a stripper bar plate mounted transversely across the table in opposed relation to the pusher bar plate. The pusher bar plate is moveable along the length of the table between a feed position that is spaced a predetermined distance from the stripper bar plate and a fold position that is located adjacent the stripper bar plate. The sheet of material is fed lengthwise onto the table and into engagement between the pusher bar plate and the table with a portion of the sheet of material located between the pusher bar plate and the stripper plate when the pusher bar plate is in the feed position. The portion of sheet material is folded into a convolution by moving the pusher bar plate to the fold position. The stripper bar plate is raised above the convolution of the sheet of material to permit the convolution to pass by the stripper bar plate along the length of the table. The stripper bar plate is lowered and the pusher bar plate is retracted to the feed position such that the pusher bar plate is in engagement with the sheet of material against the table.

10 Claims, 16 Drawing Sheets

50
56
14

34
32
2A
48
50
40
36
44
42
38
14
10
12
30

METHOD AND ASSEMBLY FOR MANUFACTURING A CONVOLUTED HEAT EXCHANGER CORE

This invention relates to the manufacture of convoluted heat exchanger cores and, in particular, to an automated process that unwinds a continuous sheet of thermally conductive material, such as aluminum, from a roll or coil, embosses the sheet of material, folds the sheet of material to form convolutions, and cuts the convoluted sheet of material into predetermined lengths to form individual convoluted heat exchanger cores.

BACKGROUND OF THE INVENTION

Heat exchangers are widely used to dissipate heat. One application is to protect sensitive electronic controls that are located in harsh industrial settings.

Heat exchangers having convoluted aluminum cores are preferred for providing closed loop cooling for enclosed electronics. In such a heat exchanger, heated enclosure air is drawn through one side of the convoluted core while cooler ambient air is pulled through the convolutions on the other side of the core in the opposite direction. Heat from the enclosure air transfers through the core to the ambient air flow and is discharged into the atmosphere. The cooled enclosure air then blows back into the enclosure. Such a heat exchanger is ideal for applications in which the electronic controls can operate at a temperature differential slightly above ambient, humidity is not a factor, and ambient air contaminants must be kept out of the enclosure.

Previously, convoluted cores were made by simply manually folding a sheet of aluminum. Various types of devices are known in the art for forming, crimping, folding, perforating and otherwise processing sheet or strip material, such as sheet metal. But these devices are generally not suitable for making the convoluted aluminum cores used in closed loop heat exchangers.

One device used in the automotive industry for manufacturing radiator cores is a rolling fin machine that utilizes a gear mesh operation to form the convolutions as the sheet material passes between the two gears. See, e.g., U.S. Pat. Nos. 1,849,944; 2,252,209 and 4,507,948. Such a device, however, has several limitations relating to the small size of the convolutions that can be formed and the flexibility necessary to quickly adjust the machine from making cores having convolutions of one height to making cores having convolutions of a different height.

Another machine for making convoluted cores is a reciprocating press machine, such as a Robinson fin machine. See, e.g., U.S. Pat. Nos. 3,760,624 and 5,722,145. The Robinson fin machine uses two opposed dies, each moveable toward and away from the other in a vertical forming stroke to form the convolutions in a sheet of material that is fed between the dies. As with the rolling fin machines discussed above, however, the Robinson fin machine generally is used to make cores having relatively small convolutions, typically two inches or less. In addition, if a different core type or pattern is desired, a different machine set up is required. On-line set up operations include setting stripper heights, setting strokes, and setting tool height relative to the strippers. All of this is time consuming, non-productive, and obviously undesirable, especially when the manufacturer specializes in serving customers with special needs and low volume orders.

A type of pleat forming machine is known to make accordion bellows and lamp shades wherein the machine includes a laterally moveable pusher bar and a vertically moveable stripper bar parallel to it and normally spaced laterally from it above a table. Generally, the stripper bar reciprocates along a path extending perpendicular to the moving web of material while the pusher bar reciprocates along a path extending generally parallel to the moving web, toward and away from the reciprocating stripper bar. The pleats are formed by compressing respective sections of web material between the two bars during each reciprocation cycle of the bars. Specifically, when the pusher bar and stripper bar are moved together, a section of sheet material is disposed between the two bars and is folded into a pleat. After each pleat is formed the stripper bar is raised, permitting the just formed pleat to pass by. See, e.g., U.S. Pat. Nos. 2,677,993; 4,201,119 and 4,650,102 incorporated herein by reference. Such machines, however, are used to fold paper or cardboard for forming accordion bellows or pleated lamp shades or to fold filter media. They have not previously been known to be used or to be useful for folding more robust materials, such as metals, including aluminum.

In view of the above, it should be appreciated that there is still a need for a machine that forms a continuous sheet of thermally conductive material, such as aluminum, into a convoluted heat exchanger core and which readily makes cores having convolutions ranging in height from two inches or less up to and exceeding twelve inches. In addition, the machine should permit quick adjustments to the size of the convolutions without removing machinery from the production line. The present invention satisfies these and other needs and provides further related advantages.

SUMMARY OF THE INVENTION

The present invention is embodied in an assembly for forming a continuous sheet of thermally conductive material, such as aluminum into a smooth or embossed convoluted heat exchanger core. The assembly significantly reduces the direct labor to make a convoluted heat exchanger core by eliminating the requirement of manual folding. The assembly also results in a faster production rate and permits the formation of an embossed pattern in conjunction with the convolutions. The assembly is also capable of producing any convolution height and the squareness of the cores are greatly improved.

The assembly for manufacturing a convoluted heat exchanger core from a continuous sheet of thermally conductive metallic material includes a pusher bar assembly having a pusher bar plate and a stripper bar plate, both mounted transversely across a table in opposed relation to each other. The pusher bar plate is moveable along the length of the table between a feed position that is spaced a predetermined distance from the stripper bar plate and a fold position that is located adjacent the stripper bar plate. The sheet of material is fed lengthwise onto the table and into engagement with the pusher bar plate. A portion of the sheet material to be folded is located between the pusher bar plate and the stripper bar plate. The sheet material is folded into a convolution by moving the pusher bar plate to the fold position. The stripper bar plate is then raised above the convolution to permit the convolution to pass by the stripper bar plate along the length of the table. The stripper bar plate is lowered and the pusher bar plate is retracted to the feed position such that the pusher bar plate is in engagement with the sheet of material against the table and in position to form another convolution.

A feature of the present invention is the use of the pusher bar assembly to fold the sheet of thermally conductive metallic material. An advantage of this feature is that convolutions of greater height can readily be formed. In particular, convolutions of two inches up to twelve inches for core widths of 18 to 48 inches are readily manufactured. In addition, the pusher bar assembly may be controlled to form consecutive cores having convolutions of different heights or even to change the height of the convolutions for any given core. This flexibility is particularly desirable for a manufacturer specializing in serving customers with special needs and low volume orders.

Another feature of the present invention is that the assembly may include a press in front of the pusher bar assembly having a die set for forming an embossed pattern on the sheet of material. An advantage of this feature is that embossed heat exchanger cores may be manufactured and the combined assembly of the pusher bar assembly and the press can be controlled to manufacture smooth or embossed cores to adjust the number of emboss patterns per convolution, or to manufacture cores with outside convolutions that are embossed or smooth.

Another feature of the present invention is that the assembly may include a feed control assembly in front of the press having a pair of feed rollers and a motor for rotating the feed control rollers. An advantage of the feed control assembly is that it provides accurate measurement of the amount of material that is fed through the press and into the pusher bar assembly. This permits accurate and consistent production of identical heat exchanger cores. In addition, the feed control assembly can include guide rails for controlling wandering of the sheet of material so as to insure the squareness of the heat exchanger cores. In addition, the feed control rollers and the press can be operated in such a manner as to permit the sheet of material to self align as it is fed through the press.

Other features and advantages of the present invention will become apparent from the following description of the preferred embodiments, taken in conjunction with the accompanying drawings, which illustrate, by way of example, the principals of the invention.

DETAILED DESCRIPTION OF THE PREFERRED EMBODIMENTS

Figure 1:
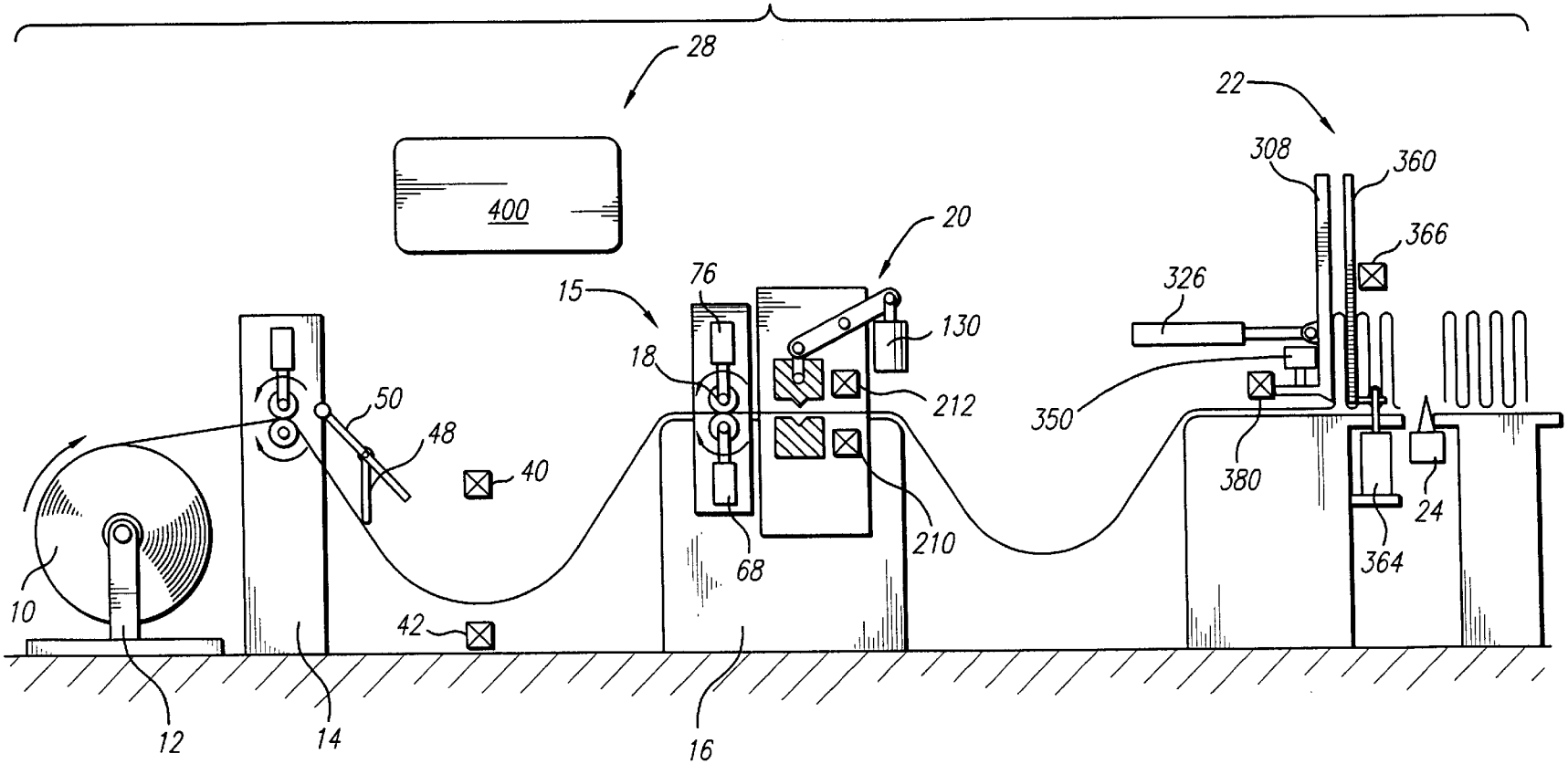
FIG. 1 is a schematic side view of the various components of a preferred assembly for making convoluted heat exchanger cores according to the present invention.
Figure 1A:
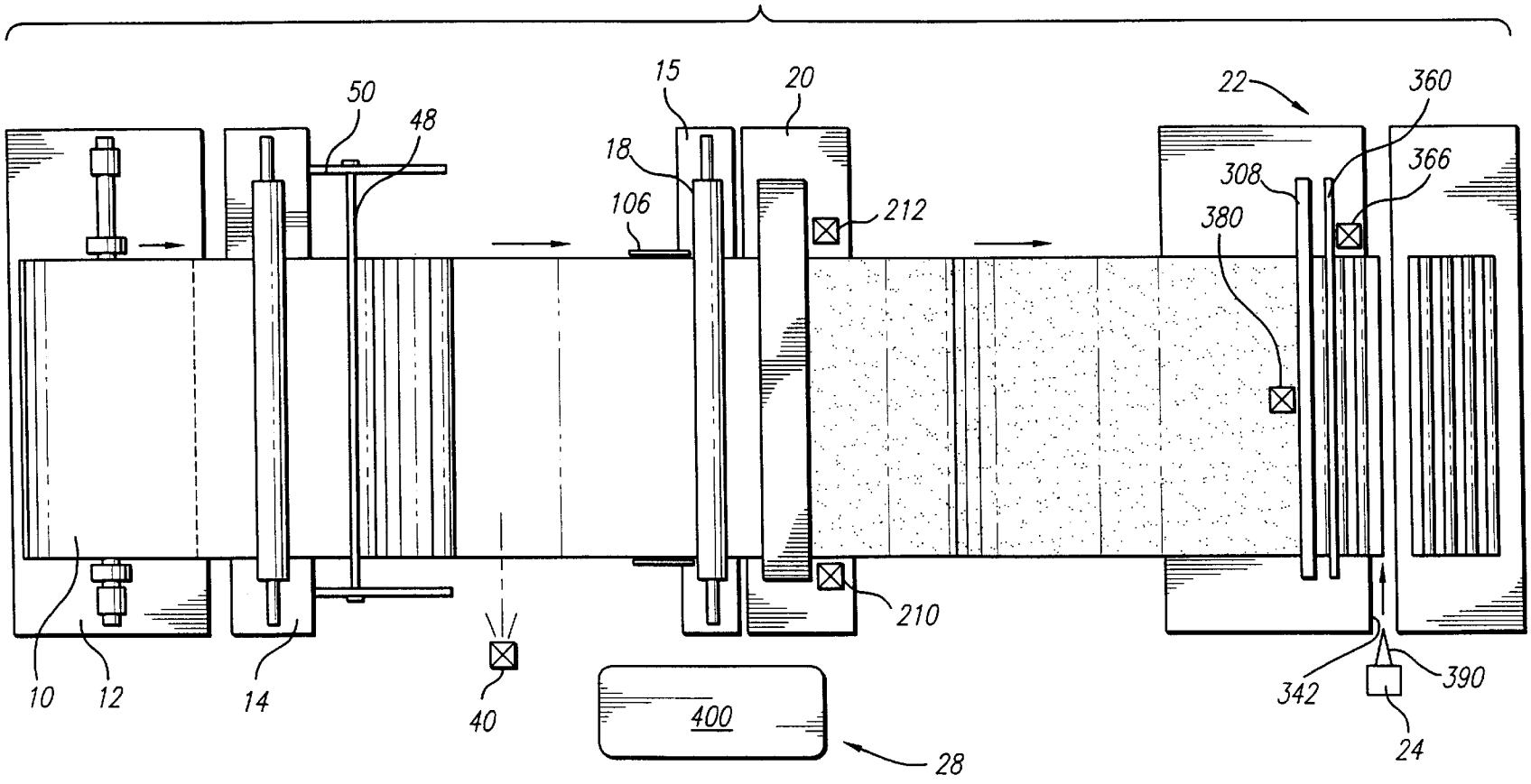
FIG. 1A is a schematic top view of the various components of the assembly of FIG. 1.

The various components of a preferred assembly for manufacturing convoluted heat exchanger cores are shown in FIGS. 1 and 1A.

A roll of thermally conductive sheet material 10, preferably 0.008 inch to 0.012 inch 1100-0 temper aluminum, or other soft aluminum material, is mounted on a support stand 12 and fed through a motorized unwind stand 14. A feed control assembly 15 includes a stand 16 that supports a pair of feed rollers 18. The rollers feed the sheet material into a press 20. The press stamps an emboss pattern into the sheet material. A pusher bar assembly 22 then takes the embossed sheet material and folds it to form convolutions. When a predetermined number of convolutions are formed, a core cut-off assembly 24 cuts them from the sheet material to form a heat exchanger core 26. A control system 28 permits adjustments in convolution height, the number of convolutions per core, and the number of emboss patterns per convolution. The control system also permits the choice of a smooth or embossed core, a multiple convolution height core, outside convolutions that are embossed or smooth, and the provision of smooth end flaps on the core for assembly.

Figures 2, 2A:
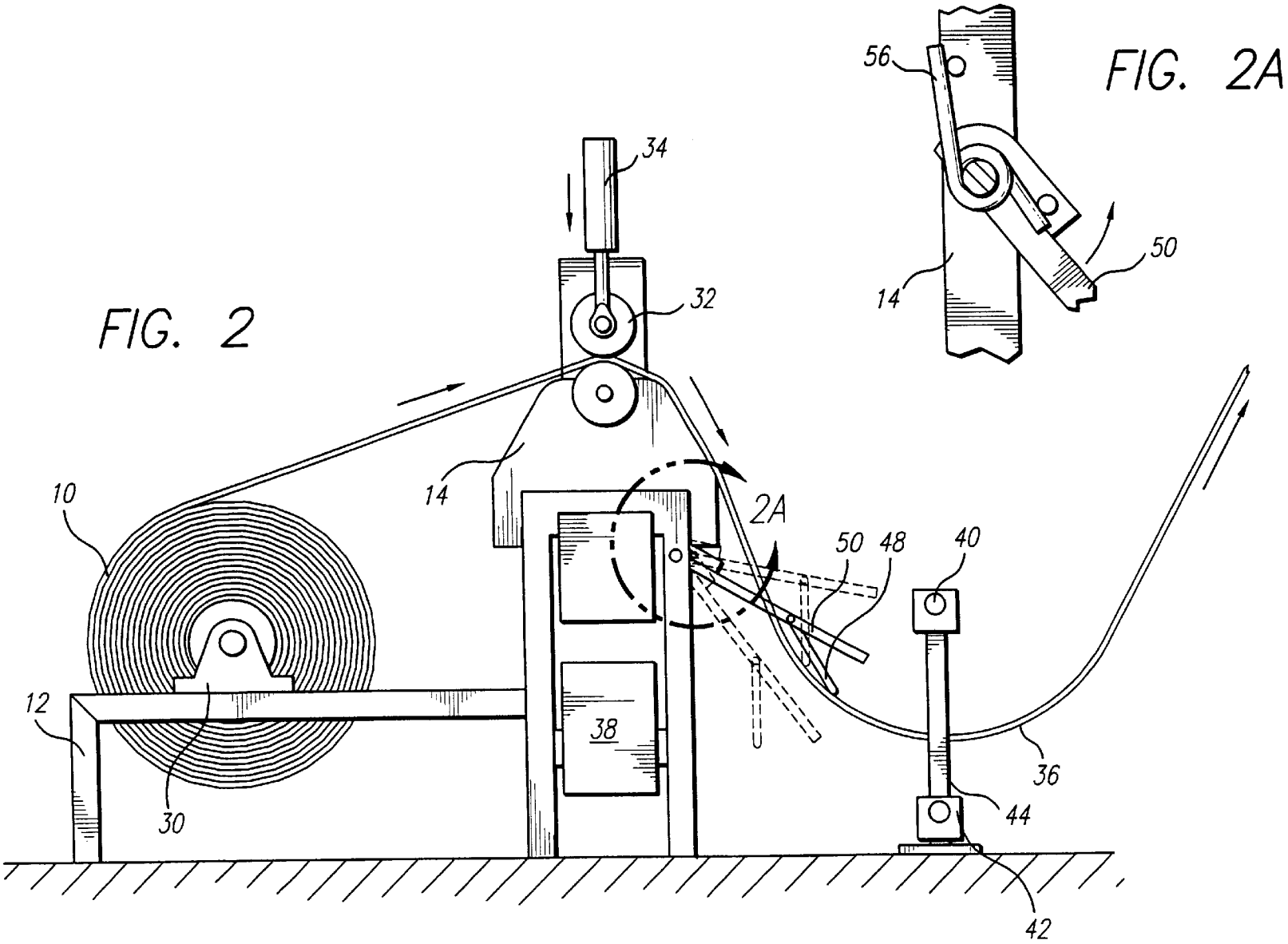
FIG. 2 is a schematic side view of an unwind stand and loop control assembly according to the present invention.
FIG. 2A is a partial side view of a spring-loaded dancer bar for the loop control assembly of FIG. 2.

With reference to FIG. 2, the support stand 12 includes a shaft 30 for receiving the roll of thermally conductive sheet material 10. Preferably, the support stand includes a brake (not shown) to prevent the roll of sheet material from uncoiling too quickly. The roll is uncoiled from the back and fed between rollers 32 of the unwind stand 14. Preferably, one of the rollers is movable vertically, for example by an air cylinder 34, to permit the sheet material to be fed through or to permit alignment of the sheet material.

The sheet material is unwound from the roll by rotation of the rollers 32 and forms a loop 36 between the unwind stand 14 and the feed control stand 16. A loop control 38 activates the rollers in response to an upper loop sensor 40 and a lower loop sensor 42 located adjacent the unwind stand. The loop sensors are mounted to a support stand 44 having a vertical strut that supports the upper loop sensor at a predetermined distance above the lower loop sensor. It will be appreciated that the loop of sheet material formed between the unwind stand 14 and the feed control stand 16 is controlled by the loop sensors in that the lower loop sensor 42 will send a signal to the loop control 38 to stop rotation of the rollers 32 and the upper loop sensor 40 will send a signal to the loop control to activate the rollers. Preferably the loop sensors are photoelectric sensors which can sense the edge of the aluminum sheet when it passes in front of the respective sensor. Other methods of monitoring the loop of sheet material are well known in the art, such as sonar sensors and dancer arm/switch mechanisms.

The unwind stand 14 preferably includes an anti-kink shield 48 to help insure that the sheet material pulled through the rollers will form an even and smooth loop between the unwind stand and the feed control stand. Preferably, the anti-kink shield extends the width of the sheet material and may be pivotably supported at each end by struts 50 coming off the sides of the unwind stand. If desired, the struts can be spring loaded at 56 away from the unwind stand (see FIG. 2A) to permit the loop 36 to begin forming before it contacts the anti-kink shield.

Figure 3:
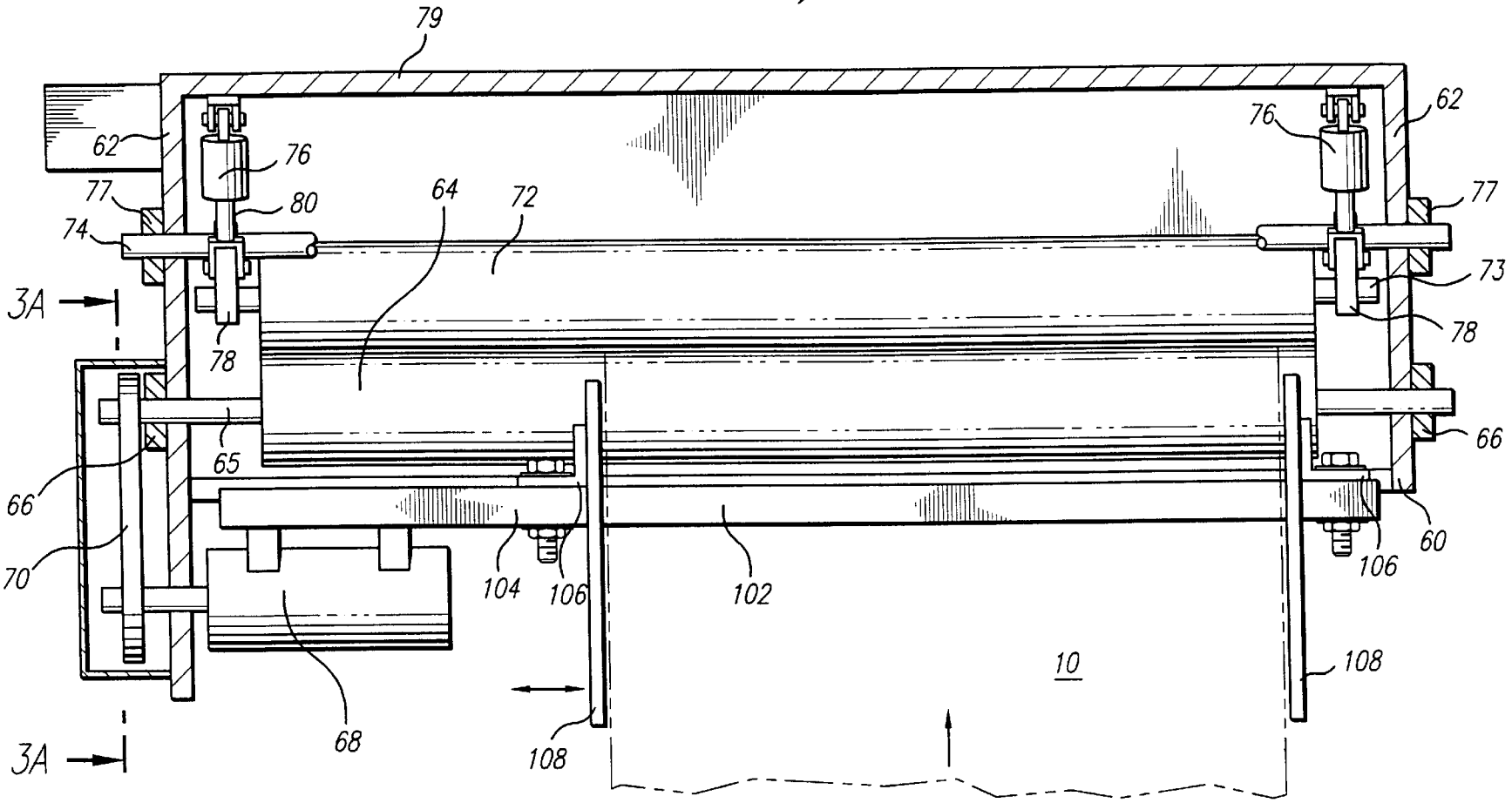
FIG. 3 is a front view of a feed control assembly according to the present invention.
Figure 4:
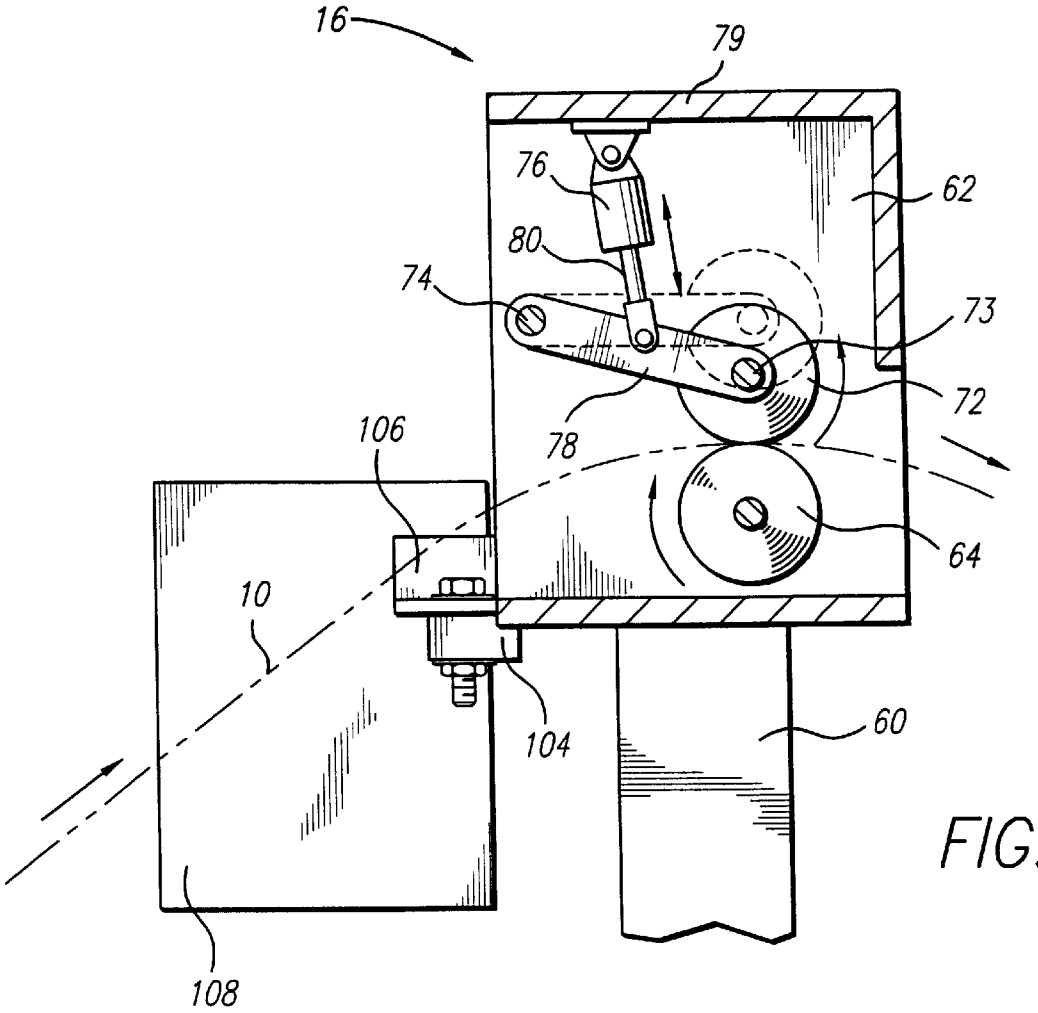
FIG. 4 is a side view of the feed control assembly of FIG. 3.
Figure 3A:
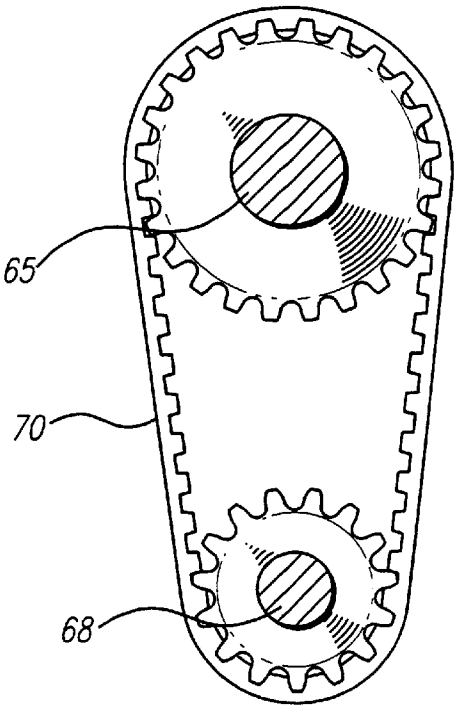
FIG. 3A is a partial sectional view of the feed control assembly of FIG. 3 taken along line 3A—3A.

With reference to FIGS. 3 and 4, the feed control stand 16 includes a frame 60 having two side walls 62. A bottom roller 64 has an axle 65 that is rotatably supported in bearings 66 mounted in the side walls. A servo-drive motor 68, including an amp and gear box is preferably mounted to the frame, and operates a timing belt 70 which drives the axle 65 of the bottom roller 64 (FIG. 3A). A top roller 72 forms a nip with the bottom roller. The top roller has an axle 73 that is supported from a support shaft 74 that extends transversely between the side walls. A pair of air cylinders 76 also support the top roller. Each end of the support shaft 74 is mounted in a bearing 77 located in the side walls of the frame. Pivot arms 78 are connected between the shaft 74 and the axle 73 of the top roller. One end of each pivot arm is connected to one end of the shaft and the other end of each pivot arm is rotatably connected to a respective end of the axle of the top roller. The air cylinders are preferably mounted to an upper support 79 of the frame. Piston rods 80 extending from the cylinders are connected to the respective pivot arms 78 near the top roller to actuate movement of the top roller between an open position, wherein the top and bottom rollers are spaced apart and a closed position wherein the top and bottom rollers form a nip through which the sheet material 10 is fed. In the preferred embodiment, the top and bottom rollers are six inch diameter steel plated rollers. The control system 28 controls the operation of a valve (not shown) connected to the air cylinders. The control system also operates the servo-drive motor, as will be discussed in detail below.

In the preferred embodiment, a slide table 102 is mounted transversely between the side walls 62 of the frame. The slide table preferably includes a channel member 104 for adjustably receiving a pair of guide rails 106. The guide rails are spaced apart a distance which is approximately the same as the width of the sheet material 10. Mounted to each guide rail is a rigid shield 108. The shields are in opposed relation to each other and form a guideway for confining the feed path of the sheet material in such a way as to control wandering. The guide rails are mounted to the channel members in any suitable manner and can be adjusted for any desired width of the sheet material. The shields are preferably made from 18 gauge galvanized sheet metal or other suitable material and have side walls to provide rigidity.

Figure 5:
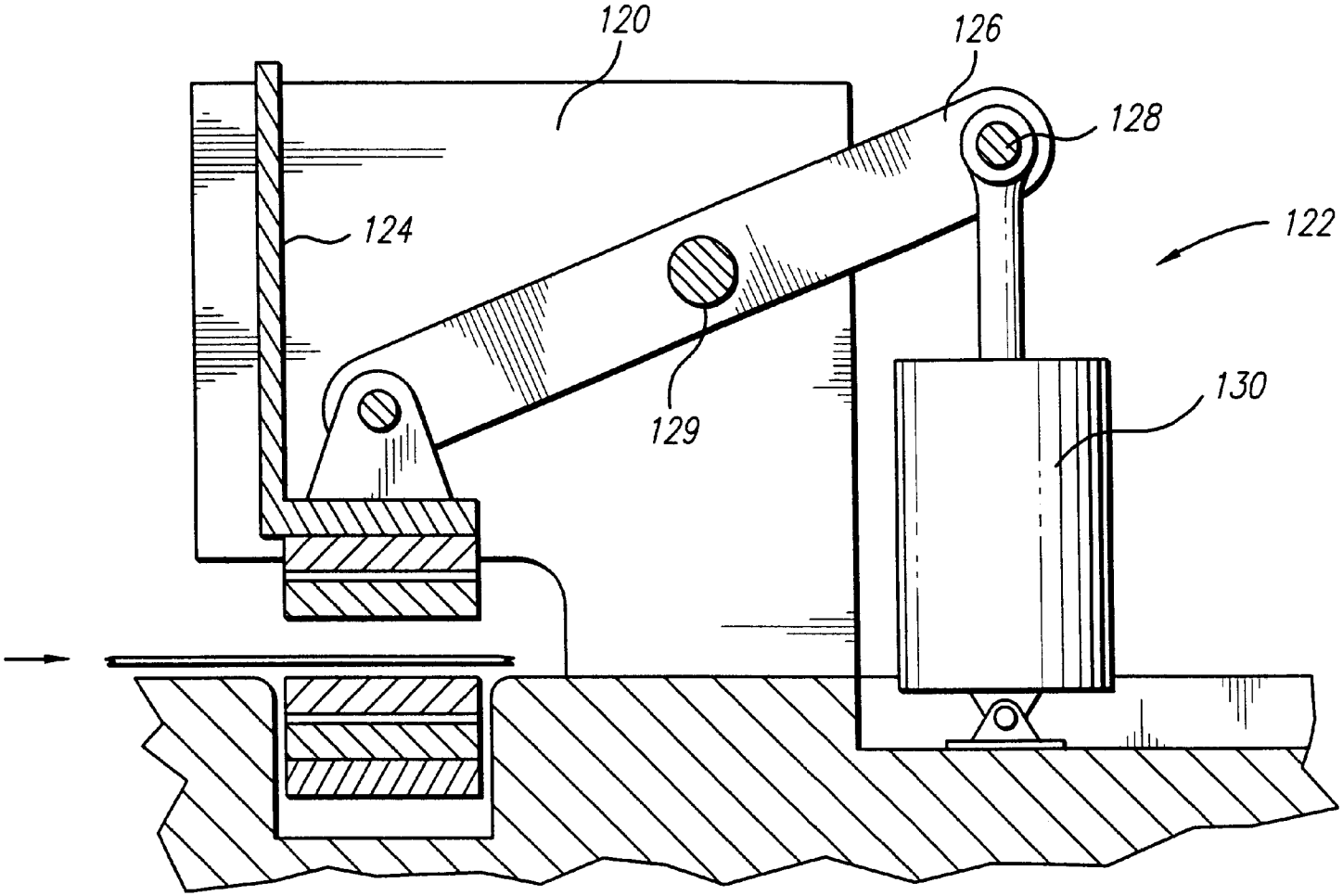
FIG. 5 is a side view of a press according to the present invention.
Figure 5A:
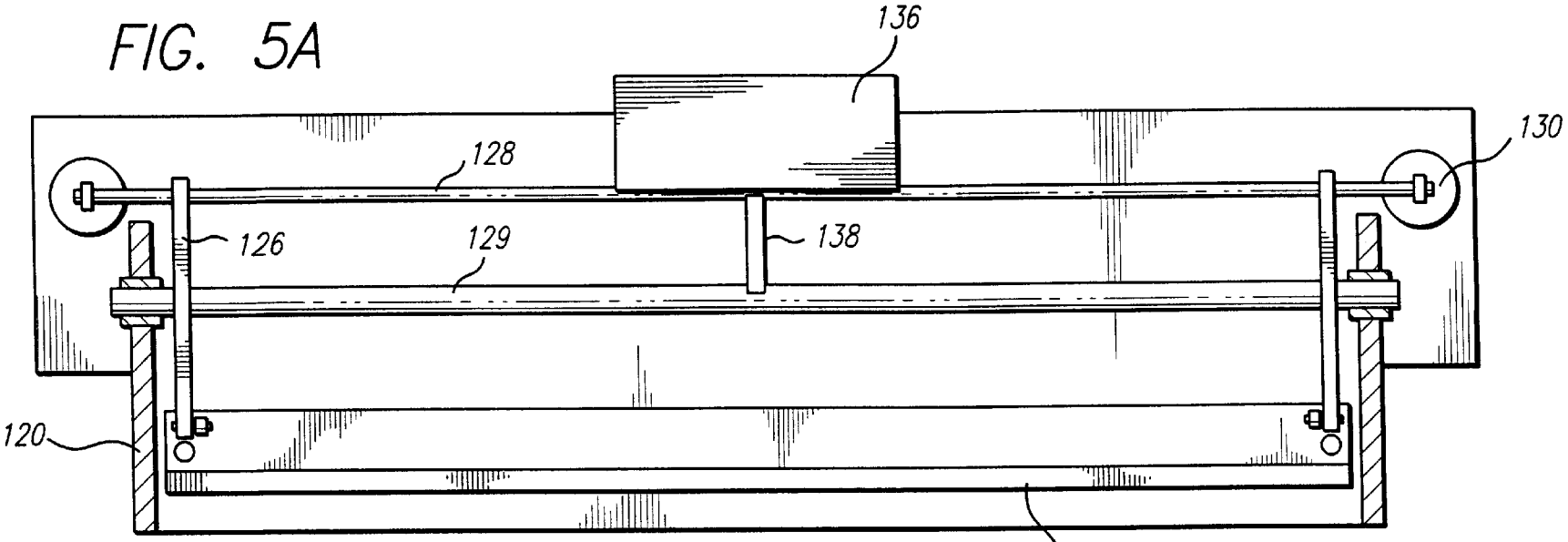
FIG. 5A is a top view of the press of FIG. 5.
Figure 5B:
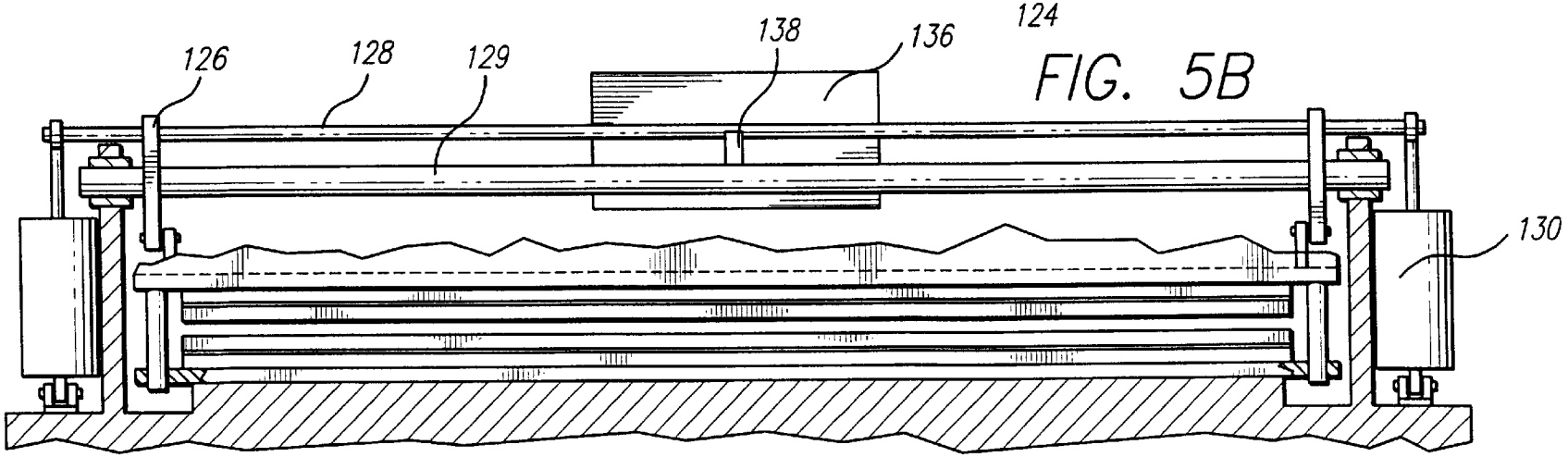
FIG. 5B is a front view of the press of FIG. 5.
Figure 6:
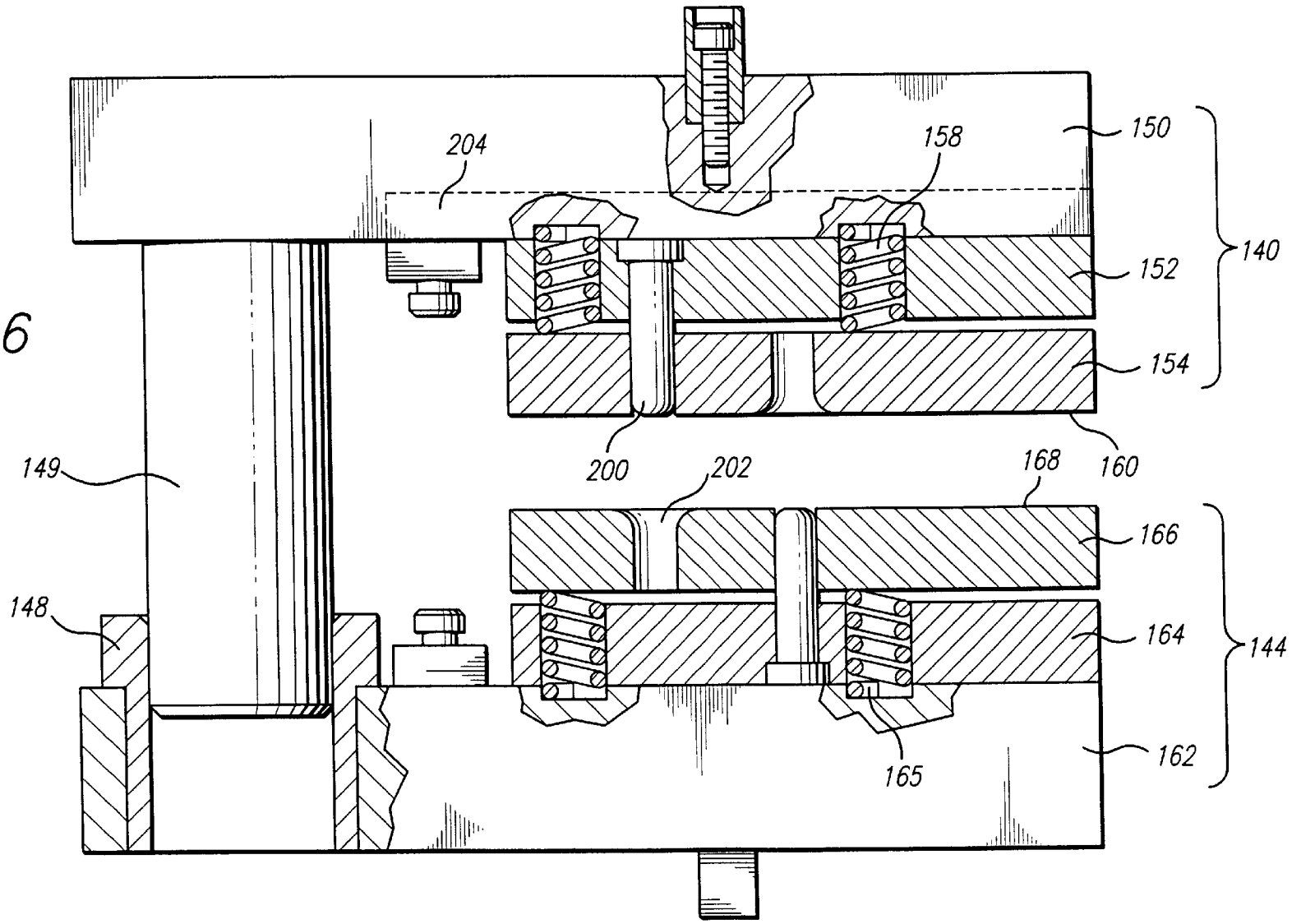
FIG. 6 is a side sectional view of a die assembly for the press of FIG. 5.

With reference to FIGS. 5, 5A and 5B, the press 20 includes two side walls 120 and a pivot frame 122 pivotably mounted between the side walls. The pivot frame includes a front wall 124, two side braces 126 that are pivotably mounted to and extend rearwardly of the front wall, a rear brace 128 extending transversely between the side braces and a pivot rod 129 between and parallel to the front wall and the rear brace. The pivot rod extends transversely through the side braces and is rotatably mounted to the side walls. A strut 138 may also be added to connect the rear brace and the pivot rod to provide further support and rigidity.

Mounted along each side wall is an air cylinder 130, each one pivotably connected to a respective end of the rear brace 128. Operation of the air cylinder raises the rear brace which causes the front plate to lower due to the see-saw action about the pivot rod. A counterweight 136 may be added to the rear brace if desired to restore the air cylinders to their lowered positions at the end of a pressing cycle. The control system 28 controls the operation of a valve (not shown) connected to the air cylinders. The control system also operates the servo-drive motor, as will be discussed in detail below.

With reference to FIGS. 6 and 7A–C, an upper die assembly 140 is mounted to the bottom of the front wall 124 of the pivot frame. A table 142 is located between the side walls of the press and receives a lower die assembly 144 in opposed relation to the upper die assembly. In order to insure proper alignment of the die assemblies during operation of the press, the lower die assembly is preferably provided with a bushing 148 at each end and the upper die assembly is provided with a post 149 at each end, which is slidably received in the respective bushing of the lower die assembly.

The upper die assembly 140 includes an upper die mount 150, an upper retainer die 152 and an upper stripper pad 154 that extend transversely across the press. The retainer die is fastened to the die mount by fasteners 155. The stripper pad is secured to the retainer die by fasteners 156 that are provided in slots 157 to permit relative movement between the stripper pad and the retainer die, as will be described below. Notably, the stripper pad has two positions relative to the retainer die. A spring 158 between the two, biases the stripper pad in a spaced-apart relation from the retainer die. A downwardly facing surface 160 of the stripper pad is provided with a suitable dimple pattern (see FIGS. 8A and 8B) for embossing the sheet material 10.

Similarly, the lower die assembly 144 includes a lower die mount 162, a lower retainer die 164 and a lower stripper pad 166. The stripper pad of the lower die assembly also has two positions relative to its respective retainer die, and springs 165 between the two, bias the stripper pad in a spaced-apart relation to the retainer die. An upwardly facing surface 168 of the lower stripper pad is provided with a dimple pattern that corresponds to the dimple pattern of the upper stripper pad.

The dimple pattern is formed by a combination of pins 200 and grooves 202 located in the upper and lower stripper pads. The pins are secured to their respective retainer dies and slide through grooves in the respective stripper pads when the press is operated. The pins may be disengaged, if desired, by sliding a tab 204 away from the die assembly 140.

Figure 8A:
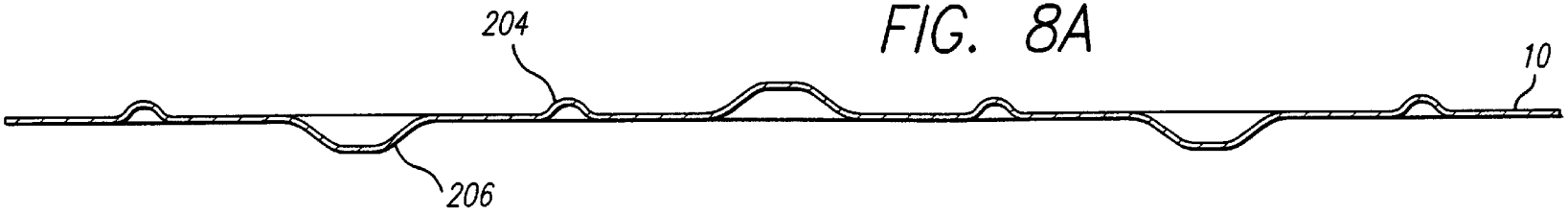
FIGS. 8A and 8B are elevational and plan views, respectively, of a sheet of material that has been embossed by the die assembly of FIG. 6.
Figure 8B:
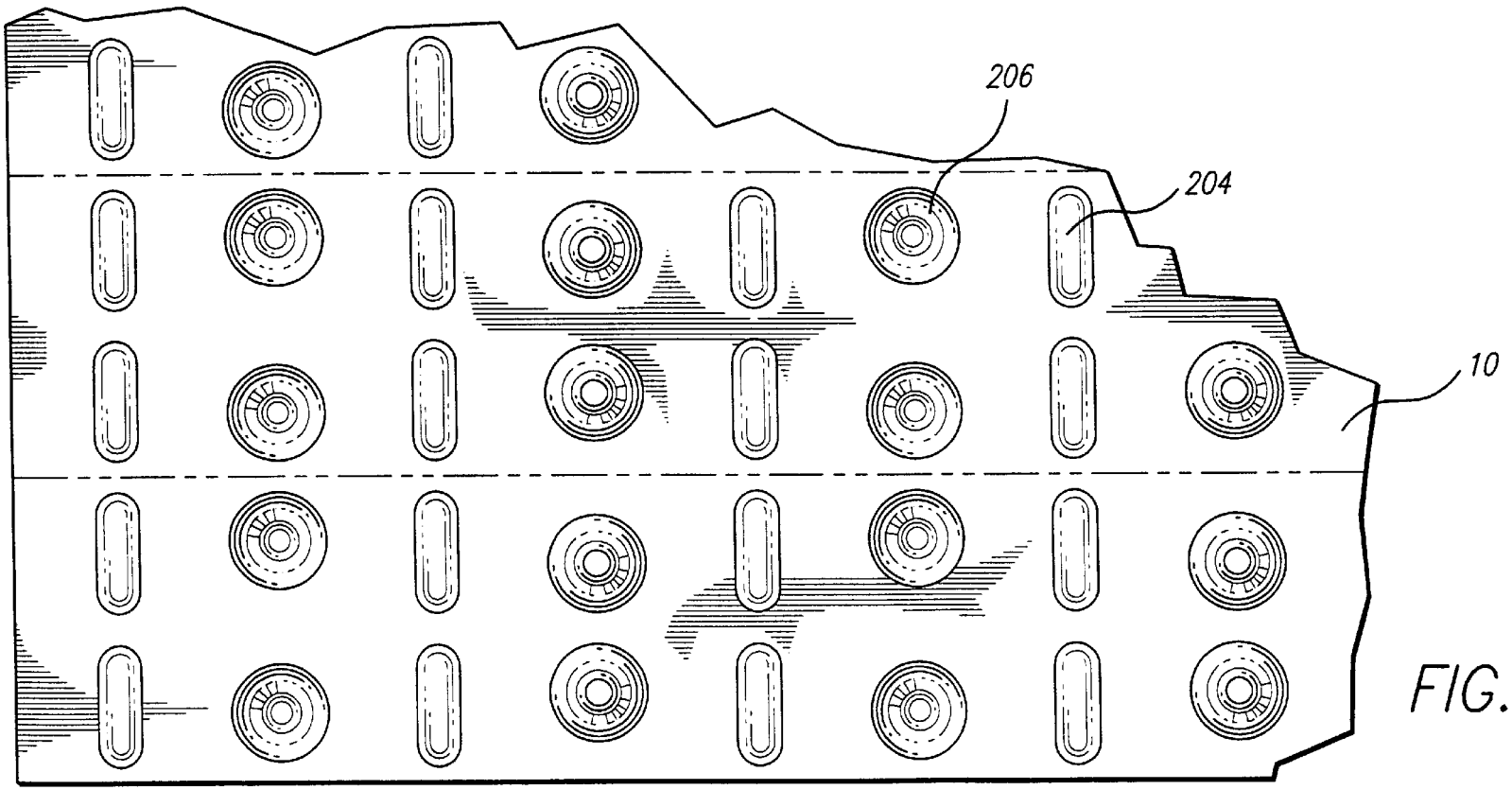

With reference also to FIGS. 8A and 8B, the sheet material is shown after it has been embossed. The preferred dimple pattern includes an alternating pattern of "hot dogs 204" and "hamburgers 206." In the embodiment shown, the "hamburgers" protrude out from the sheet material in both directions while the "hot dogs" only protrude in one direction. Such a dimple pattern is particularly beneficial in a heat exchanger core because it creates turbulence in the flow of air through the heat exchanger, which results in improved heat transfer. It will be appreciated that several other dimple patterns are suitable for providing the desired result.

Figure 7A:
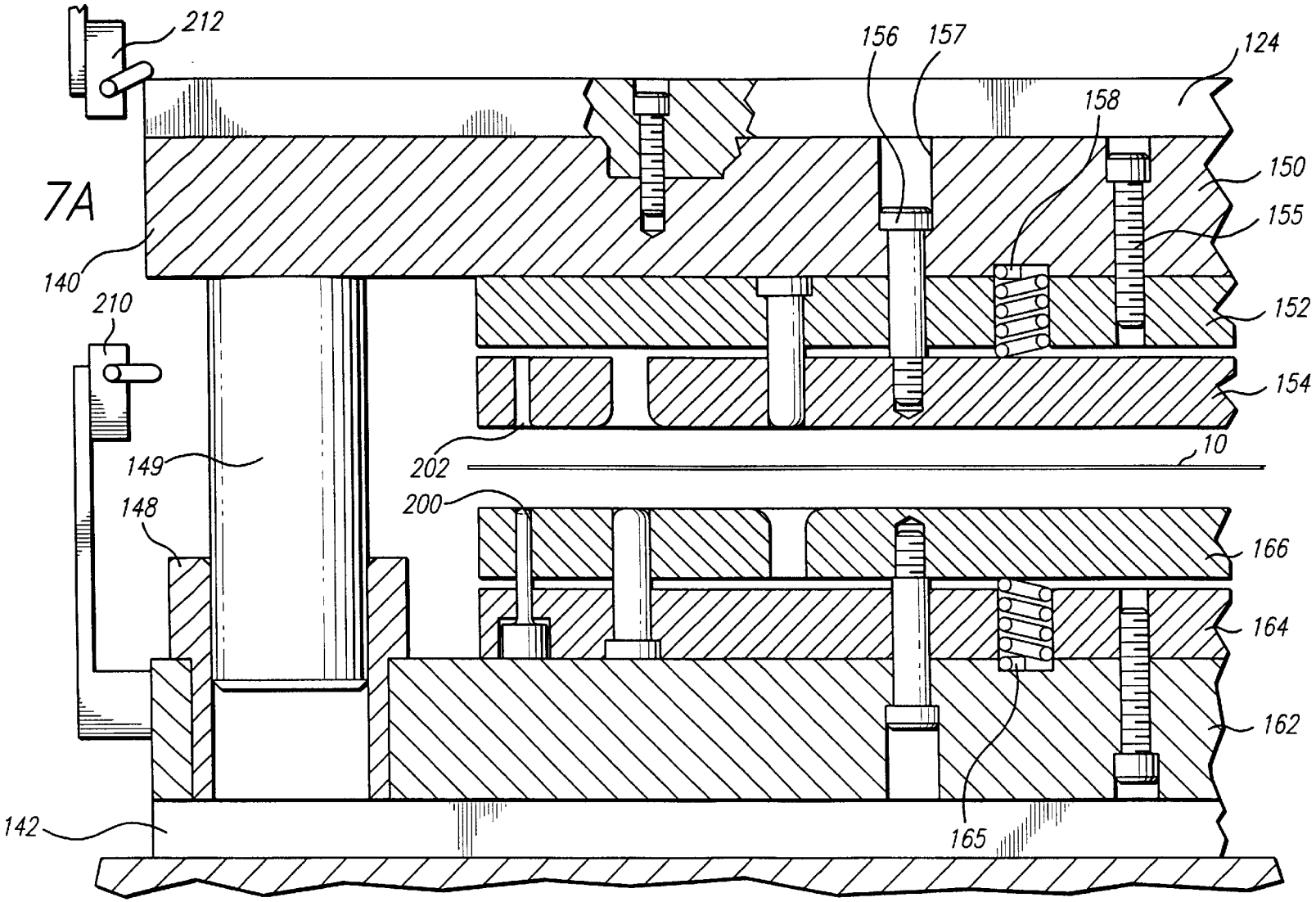
FIGS. 7A–7C are front sectional views of the die assembly of FIG. 6 at various stages of operation.
Figure 7B:
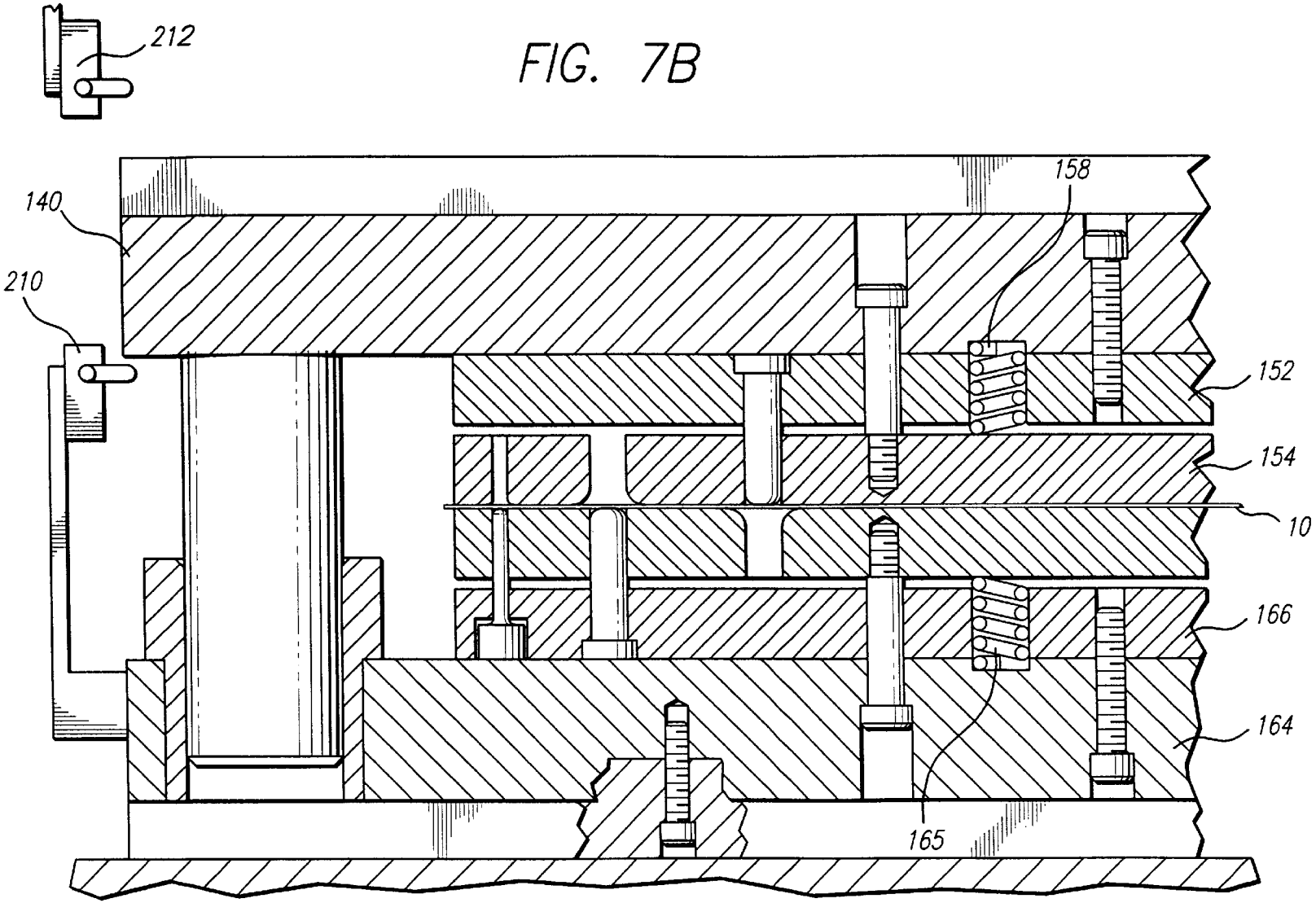
Figure 7C:
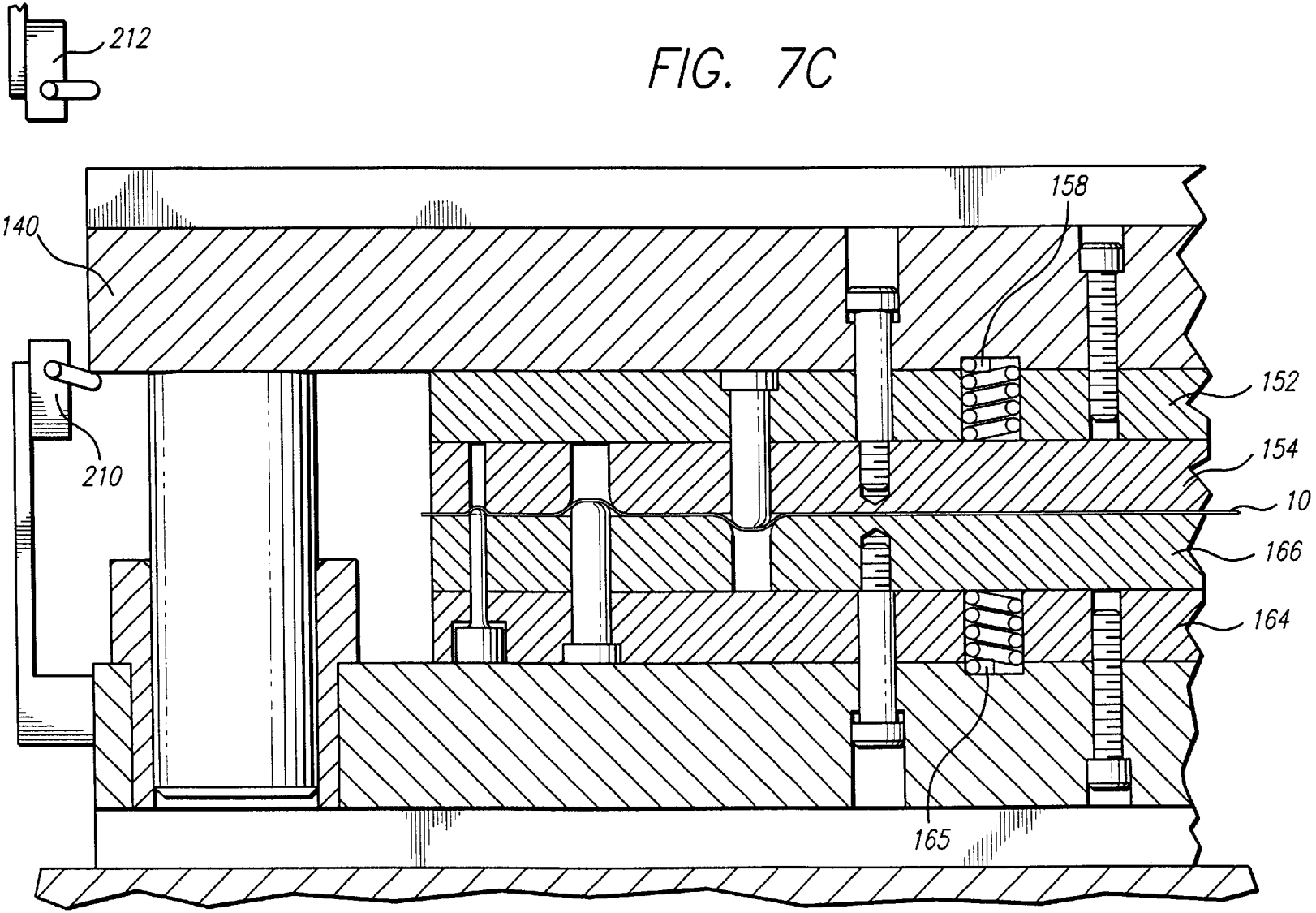

During operation of the press, the upper stripper pad 154 will contact the sheet material 10 and hold it against the lower stripper pad 166 for a brief moment (FIG. 7B) while the retainer dies 152, 164 close the gap caused by the spring bias (FIG. 7C). This sequence of events is beneficial in reducing the amount of sheet material that is pulled through the press during the embossing step because the stripper pads 154, 166 grip the sheet material and hold it in place just prior to the embossing. By reducing the likelihood that additional sheet material will be pulled through the press during operation, more accurate measurements may be made as to the width of the embossed pattern and the distance between consecutive embossed patterns. This is particularly important for coordinating the folding and cutting operations which occur subsequently, reducing errors relating to the height of the folds, locating the embossed pattern related to the folds, measuring the number of embossed patterns per fold and cutting of the sheet material into predetermined lengths.

In order to control the press and coordinate its operation with the feed rollers of the feed control assembly, the press is provided with a pair of microswitches that monitor when the press is open or closed. One microswitch 210, shown schematically in FIGS. 7A–7C, is preferably mounted to the lower die assembly 144 in front of the front wall 124 and is actuated by the upper die assembly 140 when the press is closed (FIG. 7C). The other microswitch 212 also, shown schematically in FIGS. 7A–7C, is mounted to the side wall 120 of the press behind the front wall and is actuated by the upper die assembly 140 when the press is open (FIG. 7A). The signals from the microswitches are transmitted to the control system 28 and are used to coordinate the operation of the press relative the operation of the feed control assembly and the pusher bar assembly, as will be described in more detail below.

Figure 9:
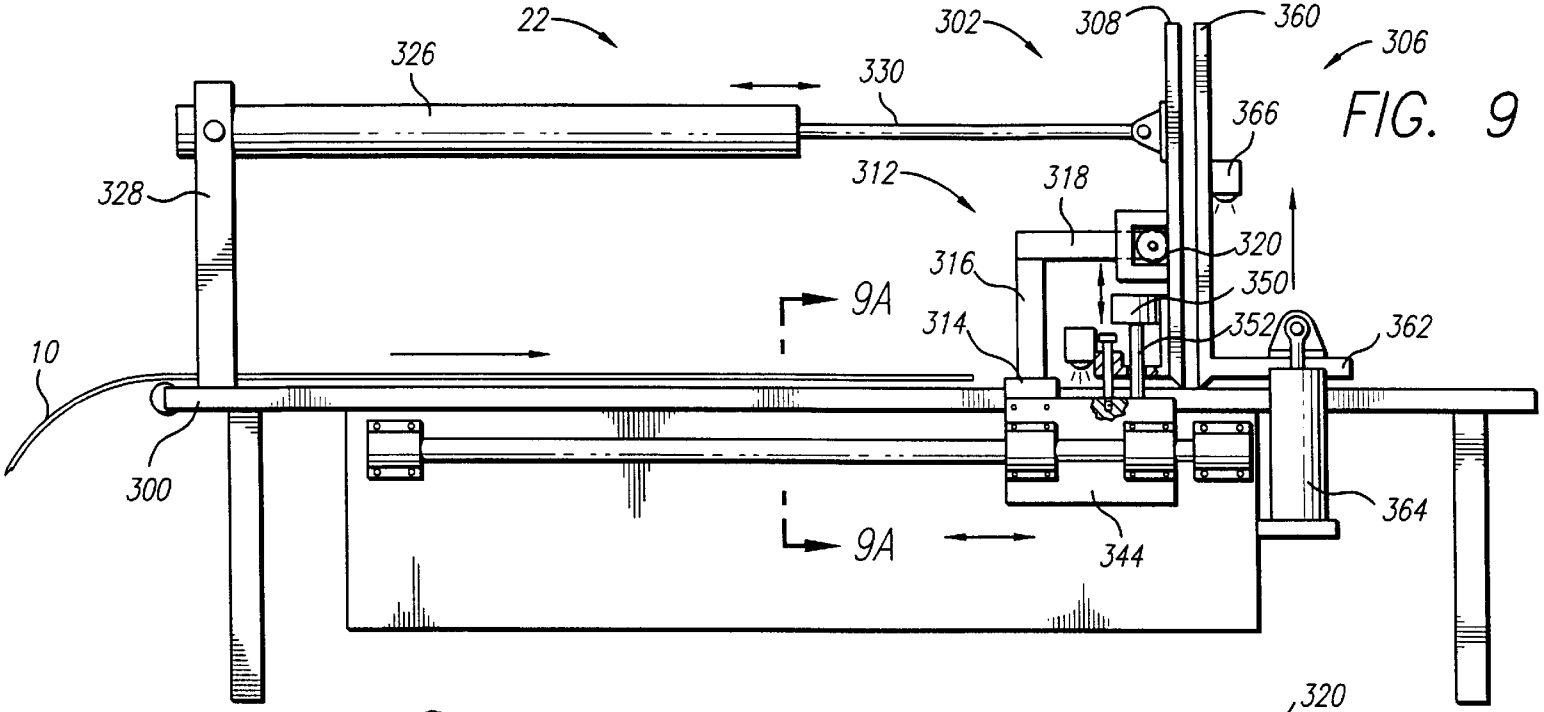
FIG. 9 is a side view of a pusher bar assembly according to the present invention.
Figure 9A:
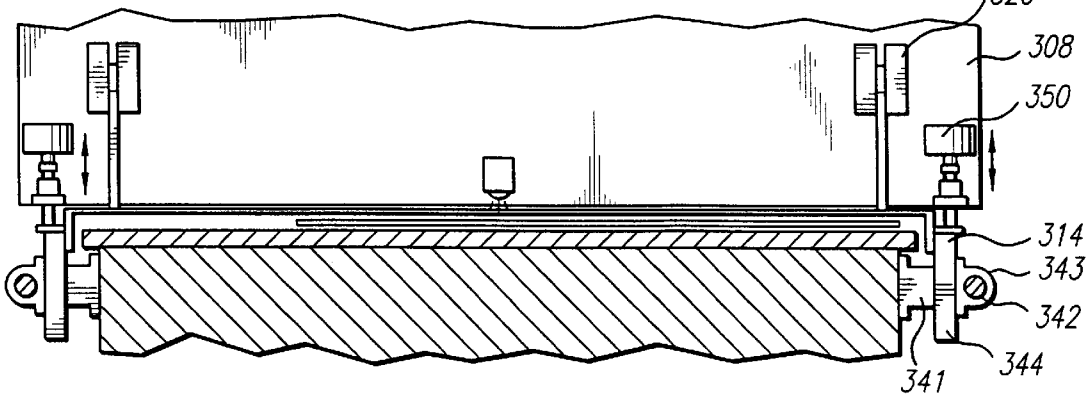
FIG. 9A is a front view of the pusher bar assembly of FIG. 9.

With reference to FIGS. 9 and 9A, the pusher bar assembly 22 includes a table 300, a pusher bar 302 and a stripper bar 306. Pusher bar assemblies are well known in connection with the manufacture of lamp shades and filter media, and are generally commercially available. One source for a pusher bar assembly is Geyer Manufacturing and Design, Inc. of Winamac, Ind.

The pusher bar 302 of the present invention includes a pusher plate 308 secured to a stabilizing bar 310 (see also FIGS. 10A and 10B), both of which extend transversely across the table. As will be described, during operation, the pusher plate is moved vertically between raised and lowered positions and is also moved toward and away from the stripper bar 306 between a fold position, wherein the pusher plate is adjacent the stripper bar, and a feed position, wherein the pusher plate is spaced a predetermined distance from the stripper bar.

To further rigidify the pusher plate 308, a frame 312 is mounted to the back of the pusher plate. The frame includes a support base 314 that extends transversely across the table. A pair of short columns 316 are mounted to the support base. Extending from the top of the columns toward the pusher plate are cantilevered arms 318. A distal end of each cantilevered arm preferably includes a cam wheel 320 against which the pusher plate rides when it is moved between its raised and lowered positions.

The support base 314 of the frame 312 is mounted to a ball slide guidance system 338 which includes a slide 340 mounted to a rail 342 on each end of the table. See also FIGS. 10A and 10B. The rail is secured by brackets 341 to the table. The slide includes bushings 343 mounted to a slide mount plate 344. The support base 314 of the frame 312 is mounted to the slide mount plate 344 by fasteners. The bushing contains one or more bearing cages containing bearings (not shown) to facilitate low friction movement along the rails.

The pusher plate 308 is moved between its fold and feed positions by a servo-linear actuator 326 which provides precision control of the pusher plate. The servo-linear actuator is mounted to a bridge 328 that transverses the table, permitting the sheet material to be fed under the bridge to the pusher bar. The servo-linear actuator has a shaft 330, the distal end of which is secured to the pusher plate to effect movement of the pusher plate between the fold and feed positions. When the servo linear actuator is operated, the pusher plate moves along the rails 342 toward and away from the stripper bar 306.

Two vertically oriented air cylinders 350 are mounted to move the pusher plate 308 between its upper and lower positions. The control system 28 controls the operation of a valve (not shown) connected to the air cylinders. Each vertically oriented air cylinder has a piston rod 352 extending downwardly. The piston rod has a distal end that passes through the stabilizing bar 310 and bears on the slide mount plate 344 (see also FIG. 10A). It will be appreciated that when the piston rod is extended, the pusher plate is moved up to the raised position and when the piston rod is retracted, the pusher plate has moved down to its lowered position.

In a preferred embodiment, a brass plate is preferably mounted across the table and fastened to the top of the slide mount plates 344 the bras plate will then move with the slide 340 along the surface of the table at low friction. The sheet of material 10 is pinched between the pusher plate 308 and the brass plate 356 during the fold operation.

The stripper bar 306 includes a stripper plate 360 and a stripper plate frame 362 that supports the stripper plate in opposed relation to the pusher plate. A pair of air cylinders 364 are mounted to each side of the stripper plate frame to permit raising and lowering of the stripper plate between its upper and lower positions. The control system 28 controls the operation of a valve (not shown) connected to the air cylinders.

A microswitch 366 is also mounted along the pusher bar assembly and is actuated by the stripper bar when the stripper bar is in its raised position. Signals from the microswitch are transmitted to the control system 28 and are used to coordinate the operation of the pusher bar assembly as will be described below.

Figure 10B:
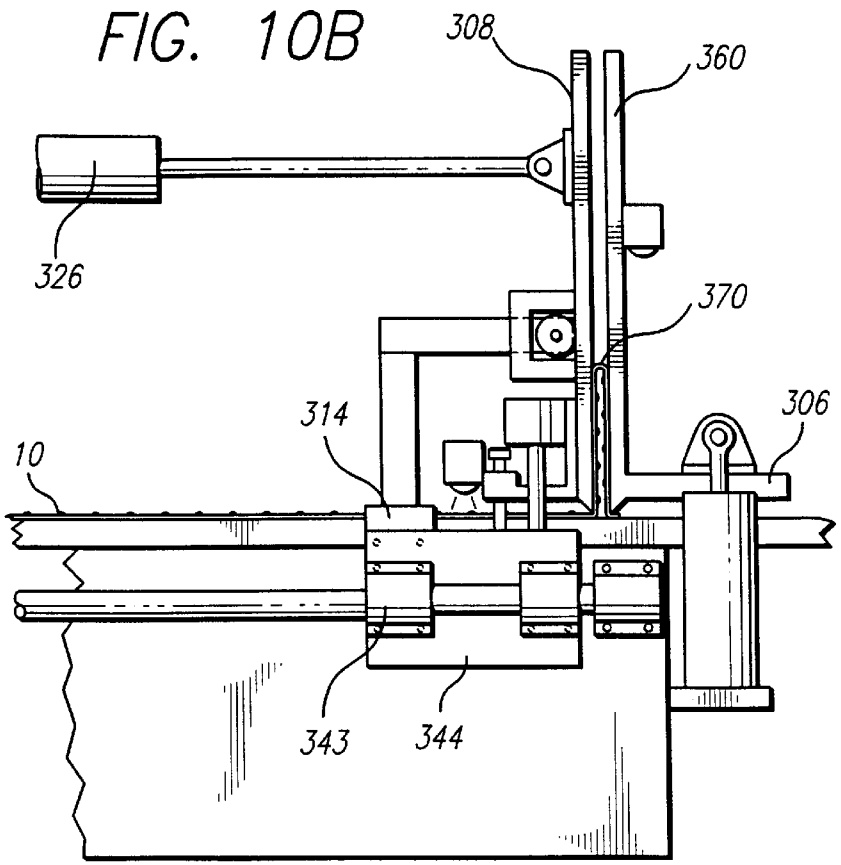
FIGS. 10A–10F are side views of the pusher bar assembly of FIG. 9 at various stages of operation.
Figure 10A:
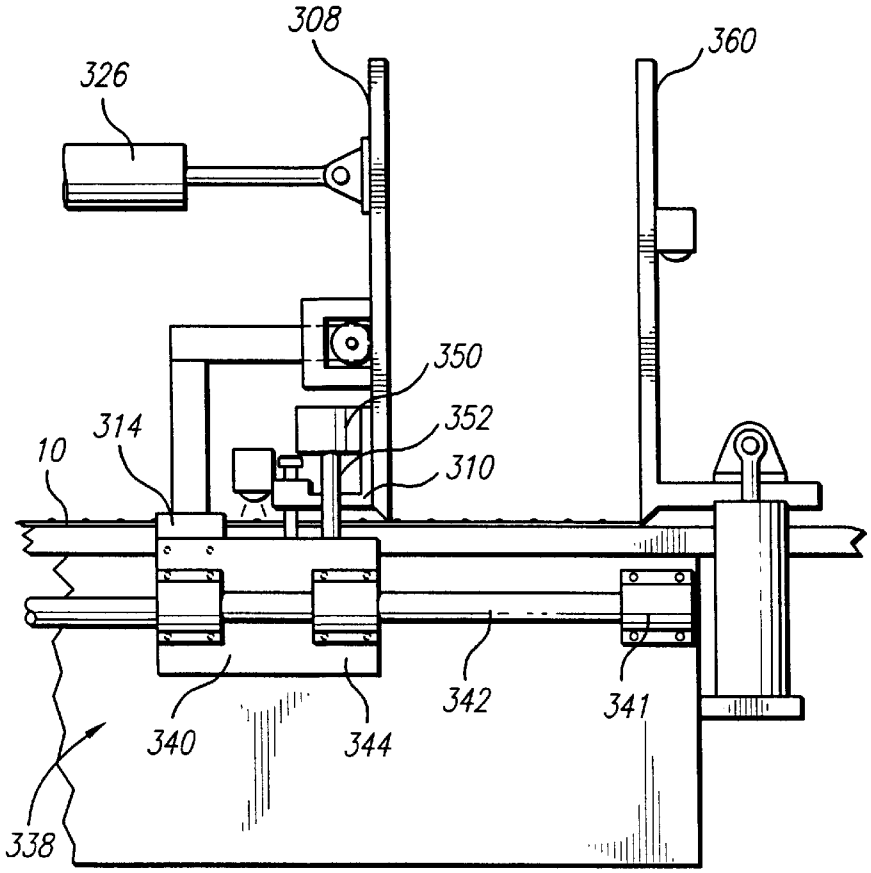

The operation of the pusher bar assembly is shown in FIGS. 10A through 10F. In the feed position, the pusher plate 308 is spaced from the stripper plate 360 and is in its lowered position such that the pusher plate 308 engages the sheet material (FIG. 10A). Notably, in order to prevent damage to the embossed pattern on the sheet material, the bottom surface of the stabilizing bar 310 is raised above the bottom edge of the pusher plate.

Energizing the servo-linear actuator 326 moves the pusher bar to the fold position (FIG. 10B). If desired, a folding blade (not shown) may be inserted in the table midway between the pusher plate and the stripper plate to initiate the fold. See, e.g., U.S. Pat. No. 2,677,993.

Figure 10D:
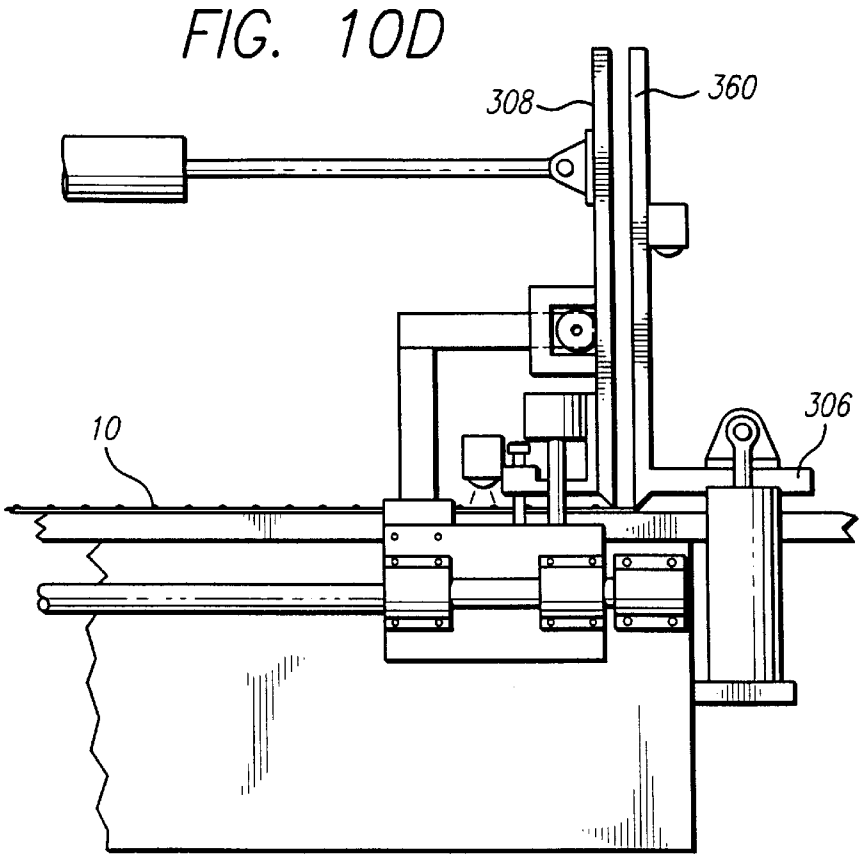
Figure 10C:
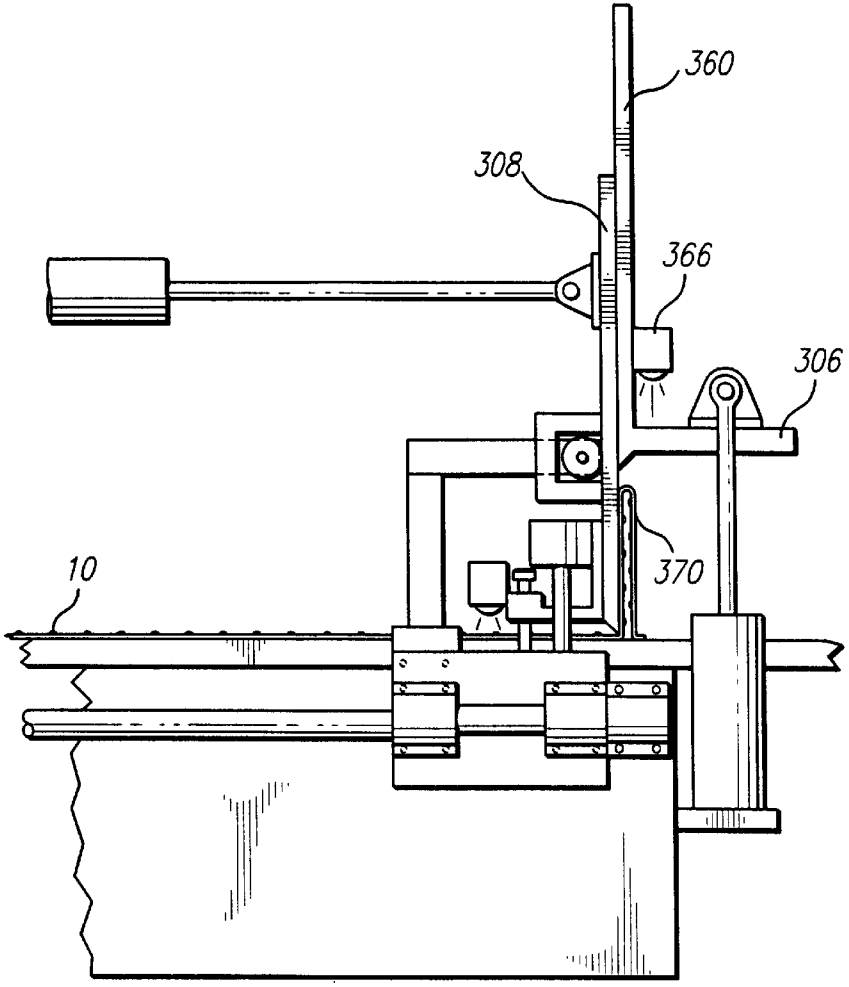

In the fold position, the pusher plate 308 is adjacent the stripper plate 360 with a fold 370 of sheet material therebetween. Next, the stripper bar 306 is raised to permit the fold to pass by (FIG. 10C). Preferably, the pusher plate 308 is moved slightly to push the fold past the stripper plate 360. The stripper bar is then lowered (FIG. 10D). Preferably, the stripper plate holds the sheet material in place while the pusher plate is raised (FIG. 10E). The pusher plate then is retracted to a location where the pusher plate is above its feed position (FIG. 10F) and lowered to the feed position (FIG. 10A) to repeat the process.

Figure 10F:
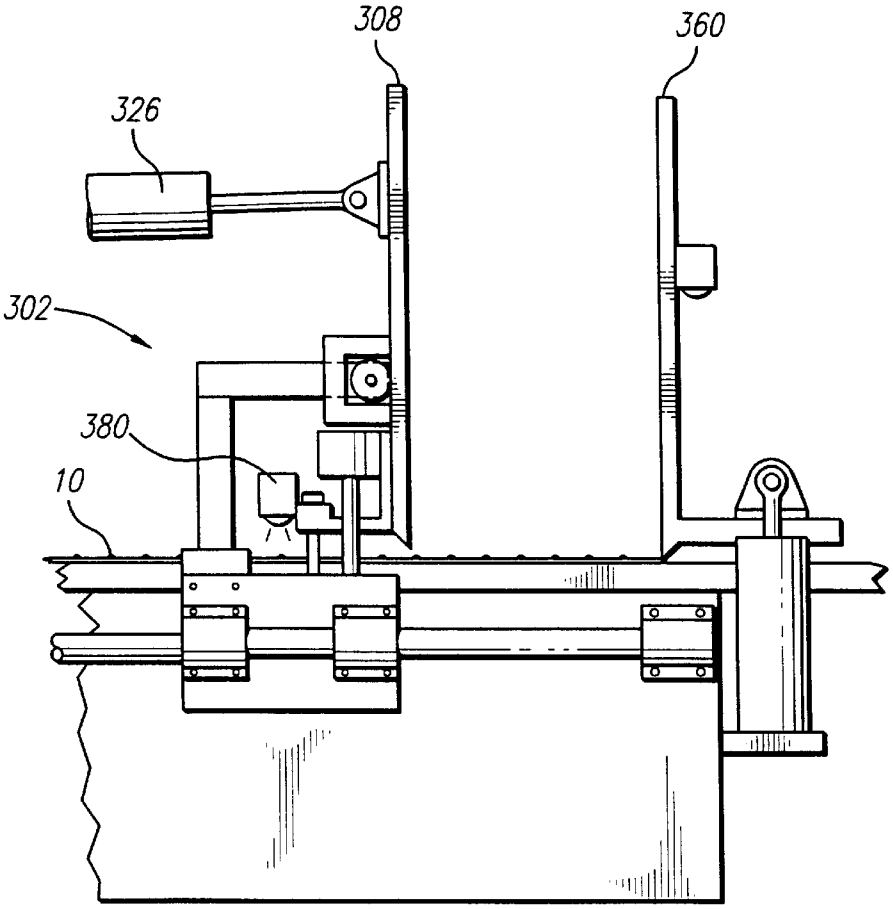
Figure 10E:
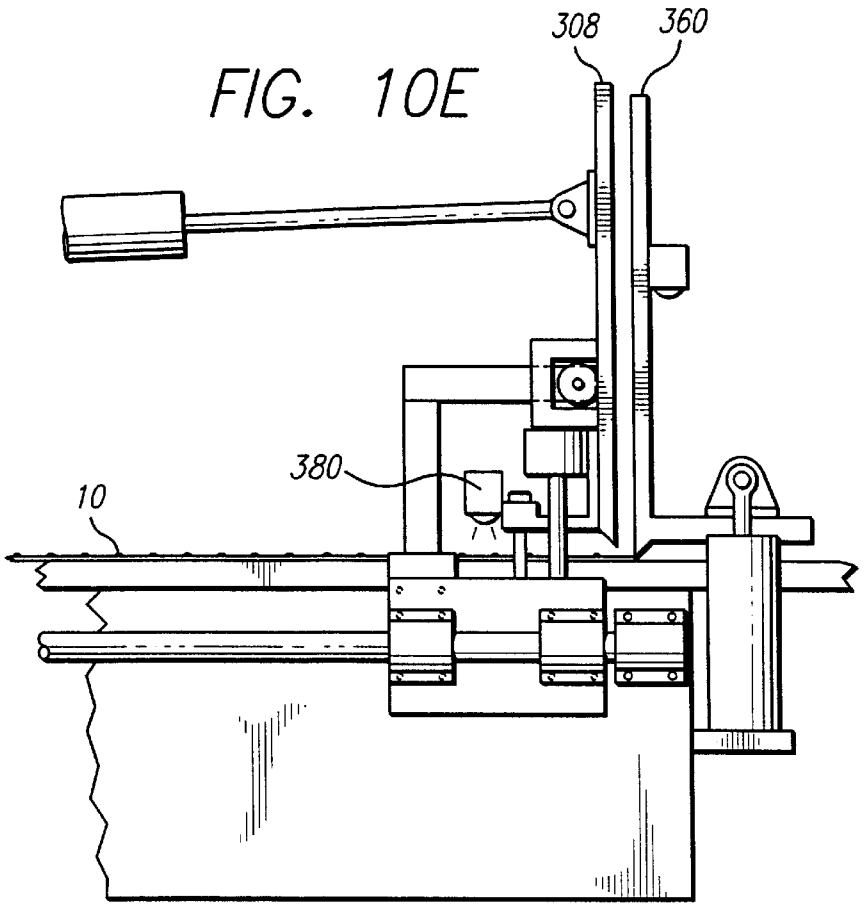

To prevent damage to the embossed pattern in the sheet material 10, an inductive proximity sensor 380 is located on the pusher bar 302 to detect one of the dimples (see FIG. 10F). The sensor provides a signal to the control system 28 which then energizes the servo-linear actuator 326 to move the pusher bar a predetermined distance from the detected location to a location where the pusher plate 308 will fall between dimple patterns and avoid any damage to the dimples.

For example, the press 20 can create a repeating two inch width dimple pattern in the sheet material with sufficient distance between each dimple pattern to permit placement of the pusher plate 308 between adjacent dimple patterns. Upon completion of a given fold operation, the control system can be programmed to energize the servo-linear actuator to move the pusher bar a predetermined distance from the stripper plate 360. Next, the sensor 380 is monitored and the pusher plate is slowly moved until the sensor detects a dimple. Once detected, the control system sends a signal to move the pusher plate a predetermined distance, which insures placement of the pusher plate at a location where it will not damage any dimples (usually between adjacent embossed patterns).

The core cut-off assembly 24 is located past the pusher bar assembly 22 and includes a rotary blade saw 390 that is reciprocated transversely through a slot 392 across the table to separate the cores as they come out of the pusher bar assembly (See FIG. 1A).

With reference again to FIGS. 1 and 1A, the control system 28 preferably includes a two-axis servo controller 400 that controls the servo-drive motor 68 for the feed rollers 18 and controls the servo-linear actuator 326 for the pusher plate 308. Both the servo-drive motor 68 and the servo-linear actuator 326 provide positional feedback to the controller. The press microswitches 210, 212, the inductive proximity sensor 380 of the pusher bar assembly and the stripper bar microswitch 366, also provide signals to the controller.

Based on the feedback signals, the controller 400 can be programmed to operate in a first loop to actuate the air cylinders 76 and the servo-drive motor 68 for the feed control rollers, and the air cylinders 130 for the press 20. The controller can also be programmed to operate in a second loop to actuate the air cylinders 350 and the servo-linear actuator 326 for the pusher plate 308 and the air cylinders 364 for the stripper plate 360.

The controllers, motors, actuators, sensors, microswitches and air cylinders mentioned above are well known in the art. For example, many are available from Parker Motion and Control of Rohnert Park, Calif. In addition, flow chart style programming software for programming the controller to operate in the types of loops described above is well known in the art. One preferred program is the Motion Builder software by Parker Motion and Control. Preferably, an operator interface (not shown) is also used to permit an operator to enter information into the two-axis servo controller 400. Such an operator interface is also available from Parker Motion and Control.

Specifically, in the first loop, opening and closing of the feed rollers 18 is coordinated with the press 20 to control wandering of the sheet material as the sheet material is fed through the press. For example, when the press is open, the microswitch 212 is activated and sends a signal to the controller 400. The controller then actuates the servo-drive 68 motor to feed a predetermined amount of sheet material through the press. Once completed, the servo-drive motor signals the controller that feeding is complete. At this time, the controller actuates the air cylinders 130 for the press, closing the press and also actuates the air cylinders 76 for the feed rollers 18, opening the rollers. Preferably, neither the press 20 nor the feed rollers 18 engage the sheet material at this moment, permitting the sheet material to be guided to a centered position by the guide rails 106. (Alternatively, the press alone engages the sheet of material while the feed rollers do not, again permitting the sheet material to move to a centered position.)

Once the press closes, the microswitch 210 is activated, sending a signal to the controller. The controller then turns off the air cylinders 130 for the press and the press opens due to the force of the counterweight 136 (see FIG. 5A). The controller also actuates the air cylinders 76 for the feed rollers to close the rollers and the process loop repeats when microswitch 212 is activated.

In the second loop, the positioning of the pusher plate 308 and the stripper plate 360, are coordinated to fold the sheet material. In addition, the movement of the pusher plate is controlled in such a manner to avoid damaging the embossed dimples on the sheet material. For example, the controller 400 can be programmed to start the loop when the pusher plate and the stripper plate are lowered onto the table in a nearly abutting position. The pusher plate air cylinders 350 are then actuated to raise the pusher plate, and the servo-linear actuator 326 is energized to move the pusher plate a predetermined distance from the pusher plate. The inductive proximity sensor 380 is then energized and the pusher plate is slowly moved to search for a dimple. Once a dimple is detected, the sensor sends a signal to the controller. A dimple is detected with this type of sensor when the sheet material is spaced a sufficient distance from the sensor, which will occur when the sensor passes over a recessed dimple, causing the sensor to turn off.

Once the dimple is detected, the servo-linear actuator 326 is stopped. The controller is then programmed to actuate the servo-linear actuator again to quickly move the pusher plate a predetermined distance that will assure that the pusher plate will not land on a dimple when lowered. A feedback signal from the servo-linear actuator is provided to the controller once the pusher plate is moved the predetermined distance. The pusher plate air cylinders 350 are then actuated to lower the pusher plate onto the sheet material and the servo-linear actuator is operated to move the pusher plate against the stripper plate to fold the sheet material. The controller can be programmed to stop the pusher plate a predetermined distance from the stripper plate to prevent damage to the embossed dimples of the folded sheet of material. A feedback signal is provided to the controller, which then actuates the air cylinders 364 for the stripper plate, causing the stripper plate to open. The stripper plate microswitch 366 then signals the controller that the stripper plate is open and the controller energizes the servo-linear actuator to push the fold past the stripper plate. The controller then receives another feedback signal from the servo-linear actuator that the movement is complete and the controller operates the air cylinder 364 to close the stripper plate, at which time the loop can repeat itself.

Counters may be added to the loops to keep track of the number of embossed patterns completed per fold and the number of folds completed. This is particularly useful in reducing the amount of waste between the press and the pusher bar assembly. For example, the controller can be programmed to stop the press after the last core is formed, but permit the pusher bar assembly to continue until the core is folded. Although a substantial length of sheet material has been fed to the pusher bar assembly it is not embossed and may be reused.

Similarly, the controller may be programmed to permit changes in fold height for consecutive cores or even change the fold height for the same core. In addition, cores can be made without embossed patterns or with certain portions of the cores unembossed, such as the end flaps, to assist in assembly of the heat exchanger. Yet another variation, is that the controller may be programmed to provide an unfolded, unembossed portion between cores to facilitate the cutting operation.

In summary, the control system 28 controls and integrates the feed control assembly 15, the press 20 and the pusher bar assembly 22. The control system uses a motion builder program to control the servo amplifiers and all of the air cylinders. It also controls the timing of these components to automatically produce complete cores. The control system is programmed to produce automatically folded embossed cores, to produce cores with more than one fold height, to allow an unfolded section to be fed out between cores to allow for cut-off, to readily produce many different types of cores, to withhold the emboss pattern on the first and last fold of the core if desired and to produce non-embossed cores if desired.

While a particular form of the invention has been illustrated and described, it will be apparent that various modifications can be made without departing from the spirit and scope of the invention. Accordingly, it is not intended that the invention be limited, except as by the appended claims.

I claim:

1. A method of manufacturing a convoluted heat exchanger core from a continuous sheet of thermally conductive metallic material, comprising:

providing a pusher bar assembly having a table, a pusher bar plate mounted transversely across the table and a stripper bar plate mounted transversely across the table in opposed relation to the pusher bar plate, wherein the pusher bar plate is movable along the length of the table between a feed position that is spaced a predetermined distance from the stripper bar plate and a fold position that is located adjacent the stripper bar plate;

feeding the sheet of material lengthwise onto the table and into engagement between the pusher bar plate and the table with a portion of sheet of material located between the pusher bar plate and the stripper bar plate when the pusher bar plate is in the feed position;

folding the portion of sheet material into a convolution by moving the pusher bar plate to the fold position;

raising the stripper bar plate above the convolution of the sheet of material to permit the convolution to pass by the stripper bar plate along the length of the table; and lowering the stripper bar plate and retracting the pusher bar plate to the feed position such that the pusher bar plate is in engagement with the sheet of material against the table.

2. The method of claim 1 wherein the folding, raising and lowering steps are repeated until the sheet of material is provided with a predetermined number of convolutions.

3. The method of claim 2, further comprising cutting the sheet of material to form a heat exchanger core having the predetermined number of convolutions.

4. The method of claim 1, further comprising:

providing a press in front of the pusher bar assembly, the press having a die set for forming an emboss pattern on the sheet of material;

feeding the sheet of material lengthwise into the die set of the press; and embossing the sheet of material with the die set;

wherein the sheet of material fed onto the table of the pusher bar assembly is an embossed sheet of material.

5. The method of claim 4, further comprising:

providing a feed control assembly in front of the press, the feed control assembly having a pair of feed rollers and a motor for rotating the feed control rollers;

feeding the sheet of material lengthwise through the pair of feed rollers; and operating the feed rollers to feed the sheet of material into the press.

6. The method of claim 5, further comprising:

providing an actuator for moving one roller of the pair of feed rollers between an open position that is spaced from the other roller of the pair of rollers and a nip position that is adjacent the other roller.

7. The method of claim 6, further comprising:

providing a control system that controls the press, the motor and the actuator;

operating the control system such that the one roller of the pair of feed rollers is in the open position when the press is embossing the sheet of material with the die set.

8. The method of claim 7, wherein the sheet of material is provided in a roll and further comprising:

providing an unwind stand in front of the feed control assembly, the unwind stand including a pair of rollers;

feeding the sheet of material through the pair of rollers of the unwind stand;

actuating the pair of rollers of the unwind stand to unwind the sheet of material and form a loop between the unwind stand and the feed control assembly.

9. The method of claim 8, further comprising:

providing a loop control and upper and lower loop sensors;

controlling the loop between upper and lower limits using the loop control and the upper and lower loop sensors.

10. The method of claim 4, further comprising:

providing a sensor on the pusher bar assembly;

moving the pusher bar plate to a predetermined location along the table;

monitoring the sensor and moving the pusher bar plate along the table to permit the sensor to detect the emboss pattern on the sheet of material; and moving the pusher bar plate in response to detection of the emboss pattern to the feed position, wherein the feed position is at a location such that the pusher bar plate engages the sheet of material other than at the emboss pattern.

* * * * *